United States Patent [19]

Brown

[11] 4,315,522

[45] Feb. 16, 1982

[54] FLUID DISTRIBUTION APPARATUS

[76] Inventor: Ray M. Brown, 4548 N. Milwaukee, Chicago, Ill. 60630

[21] Appl. No.: 94,369

[22] Filed: Nov. 15, 1979

[51] Int. Cl.[3] ..... B65H 75/34

[52] U.S. Cl. ..... 137/355.17; 137/355.27

[58] Field of Search ..... 137/355.17, 355.26, 137/355.27

[56] References Cited

U.S. PATENT DOCUMENTS

| | | | |
|---|---|---|---|
| 386,751 | 7/1888 | Loomis | 285/137 R |
| 2,191,728 | 2/1940 | Purcell et al. | 137/355.17 |
| 2,629,630 | 2/1953 | Roark | 137/355.21 |
| 2,640,724 | 6/1953 | Sanders et al. | 137/355.17 |
| 3,552,425 | 1/1971 | Olson | 137/355.17 |
| 3,662,777 | 5/1972 | Plunkett et al. | 137/355.17 |
| 4,224,960 | 9/1980 | Nederman | 137/355.26 |

*Primary Examiner*—A. Michael Chambers

*Attorney, Agent, or Firm*—Emrich, Root, Lee, Brown & Hill

[57] ABSTRACT

A fluid distribution apparatus embodying a reel having a multi-hose flexible conduit mounted thereon and connected thereto for feeding working fluid through one hose and drawing a vacuum through the other hose.

12 Claims, 8 Drawing Figures

FIG. 1
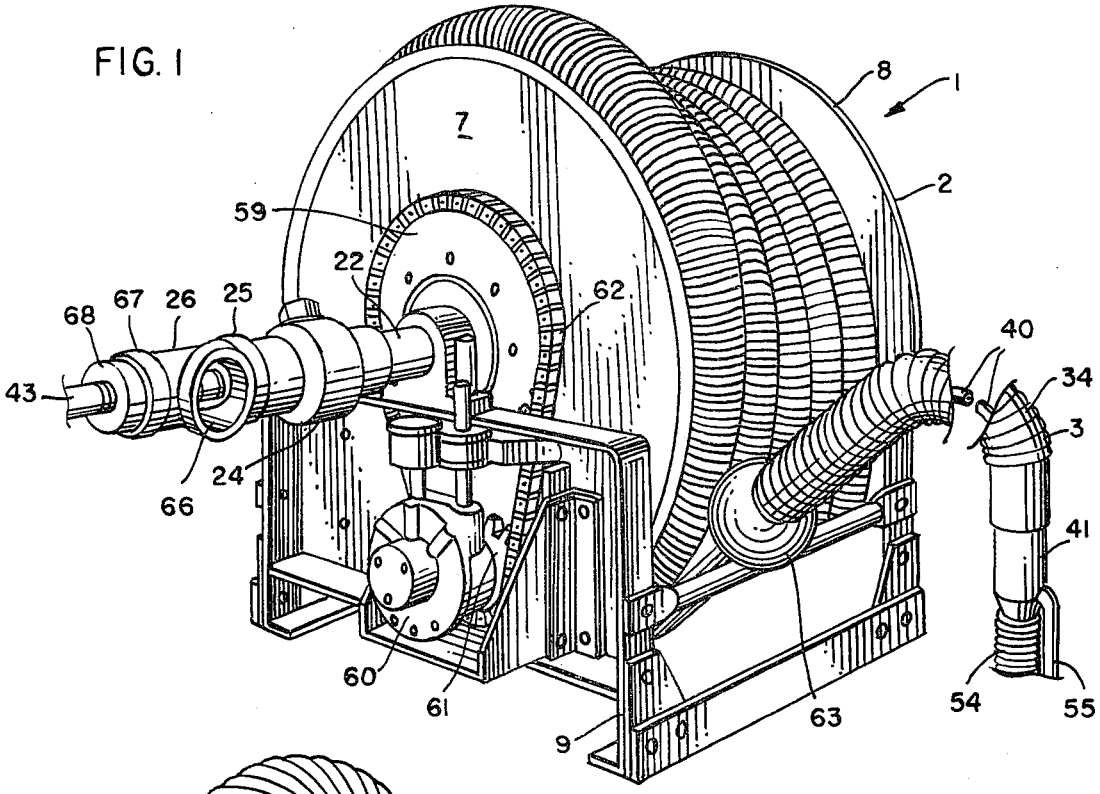
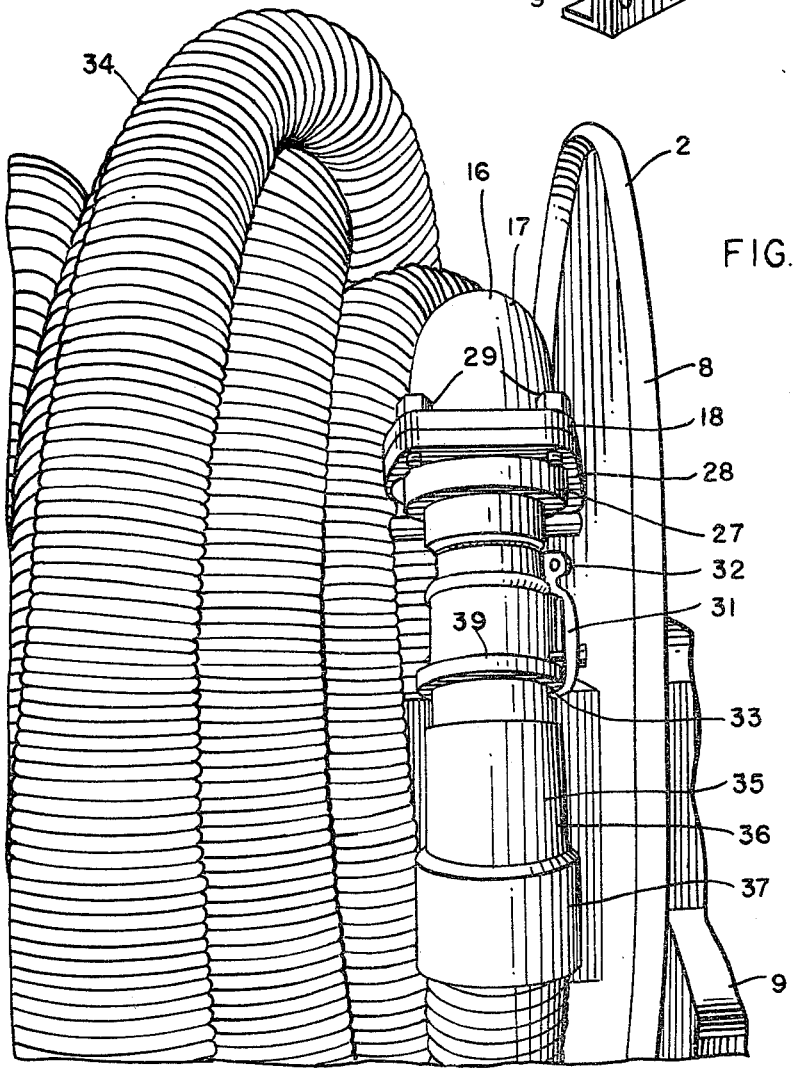
FIG. 2

FIG. 5
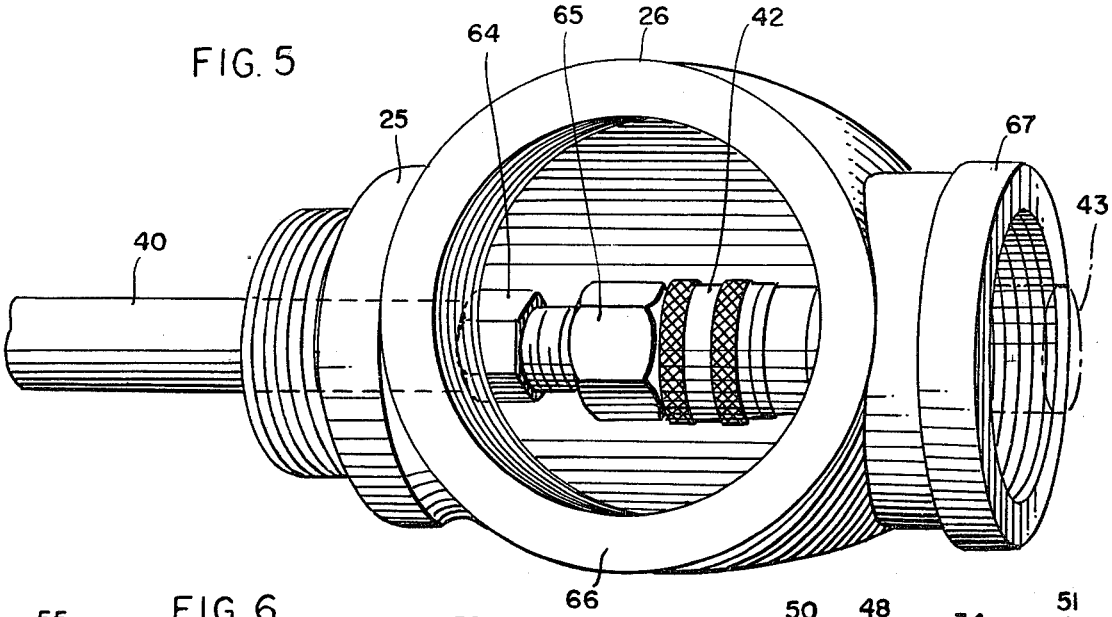
FIG. 6
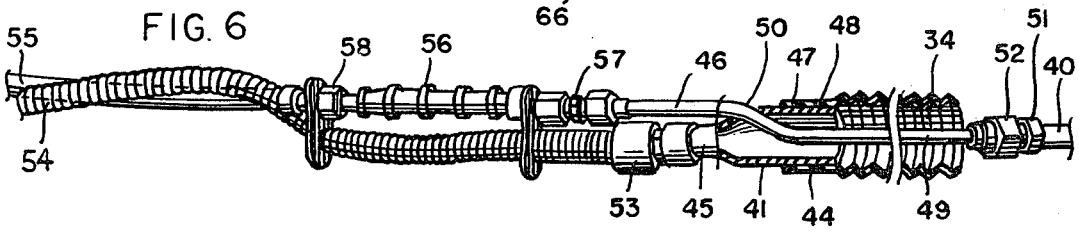
FIG. 7
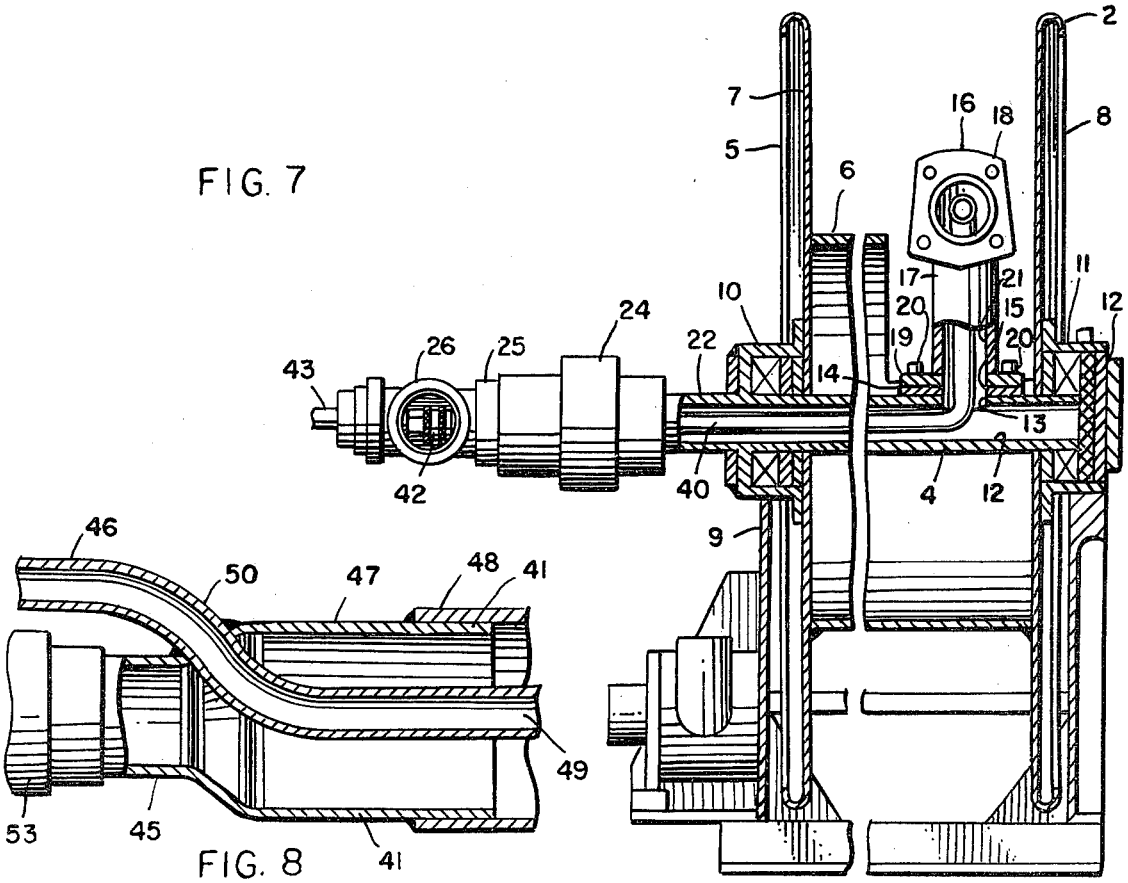
FIG. 8

FLUID DISTRIBUTION APPARATUS

BACKGROUND OF THE INVENTION

This invention relates to fluid distribution apparatus, and, more particularly, to fluid distribution apparatus which is particularly well adapted for use in connection with sanding operations, and the like.

A primary object of the present invention is to afford a novel fluid distribution apparatus.

Another object of the present invention is to afford a novel fluid distribution apparatus for feeding working fluid through two hoses.

In certain commercial operations, such as sanding operations, and the like, the sander commonly is driven by working fluid, such as compressed air, or the like, fed thereto through a power hose, and the air around the sander is withdrawn, by suction or vacuum, through a separate hose to thereby reduce the amount of dust and sand particles in the air surrounding the sander. Commonly, the sander is disposed within a hood, or the like, and the vacuum hose is connected to the hood for withdrawing dust and air therefrom.

Heretofore, insofar as I know, when such fluid feeding has been performed, it has been performed through separate hoses or conduits. Commonly, the air pressure hose and the vacuum hose have heretofore been two separate hoses extending from the air pressure source and the vacuum source, respectively, across the floor of the shop, or the like. It is an important object of the present invention to afford improvements over the apparatus heretofore known in the art for simultaneously supplying air pressure and vacuum for such operations.

Another object of the present invention is to afford a novel fluid distribution apparatus which is particularly well adapted for feeding working fluid, such as compressed air, to a sander, or the like, for driving the latter, and simultaneously drawing working fluid, in the form of air surrounding the sander or the like, from the locality of the sander.

Another object of the present invention is to afford a novel fluid distribution apparatus or the aforementioned type, which embodies a flexible, elongated, multi-passage conduit mounted on a reel for winding thereonto and unwinding therefrom.

Multi-passageway conduits for feeding working fluid therethrough have been heretofore known in the art, and, in some instances, have been mounted on reels. For example, fluid feeding apparatus embodying a plurality of hoses individually mounted on a rotatable reel have been heretofore known in the art, being shown, for example, in U.S. Pat. No. 2,629,630, which issued to L. S. Roark on Feb. 24, 1953. Also, fluid feeding apparatus, embodying a plurality of hoses disposed in a single casing and mounted on a rotatable reel have been heretofore known in the art, being shown, for example, in U.S. Pat. No. 2,640,724, which issued to E. J. Sanders et al on June 2, 1953. In addition, fluid feeding apparatus embodying a water hose for use in fighting fires, and having an air hose disposed therein have been heretofore known in the art, being shown, for example, in U.S. Pat. No. 386,751, which issued to S. L. Loomis on July 24, 1888. It is an important object of the present invention to afford improvements over such fluid feeding apparatus heretofore known in the art.

Another object of the present invention is to afford a novel fluid distribution apparatus of the aforementioned type which embodies a novel conduit comprising two passageways constituted and arranged therein in a novel and expeditious manner.

Yet another object of the present invention is to afford a novel fluid feeding apparatus of the aforementioned type, wherein the reel thereof embodies connectors constituted and arranged in a novel and expeditious manner for connecting such a conduit to a source of vacuum and a source of working fluid.

A further object of the present invention is to afford a novel fluid feeding apparatus of the aforementioned type wherein the conduit thereof embodies a novel connector constituted and arranged in a novel and expeditious manner in one end portion of the conduit.

An object ancillary to the foregoing is to afford a novel connector of the aforementioned type which embodies a main body portion connected to one portion of the conduit, and two branches projecting outwardly from the body portion for connection to respective hose portions of the conduit.

Another object of the present invention is to afford a novel fluid feeding apparatus of the aforementioned type which is practical and efficient in operation and which may be readily and economically produced commercially.

Other and further objects of the present invention will be apparent from the following description and claims and are illustrated in the accompanying drawings, which, by way of illustration, show the preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

In the drawings:

FIG. 1 is a perspective view of a fluid feeding apparatus embodying the principles of the present invention;

FIG. 2 is a fragmentary perspective view of a portion of the apparatus shown in FIG. 1;

FIG. 5 is an enlarged, detail elevational view of the T-connector shown in FIG. 1;

FIG. 6 is a fragmentary, elevational view of the free end portion of the conduit shown in FIG. 1;

FIG. 7 is an elevational view, partially in section, of the reel of the apparatus shown in FIG. 1; and FIG. 8 is a fragmentary, detail sectional view through the connector shown in FIG. 6.

DESCRIPTION OF THE EMBODIMENT SHOWN HEREIN

Figure 3:
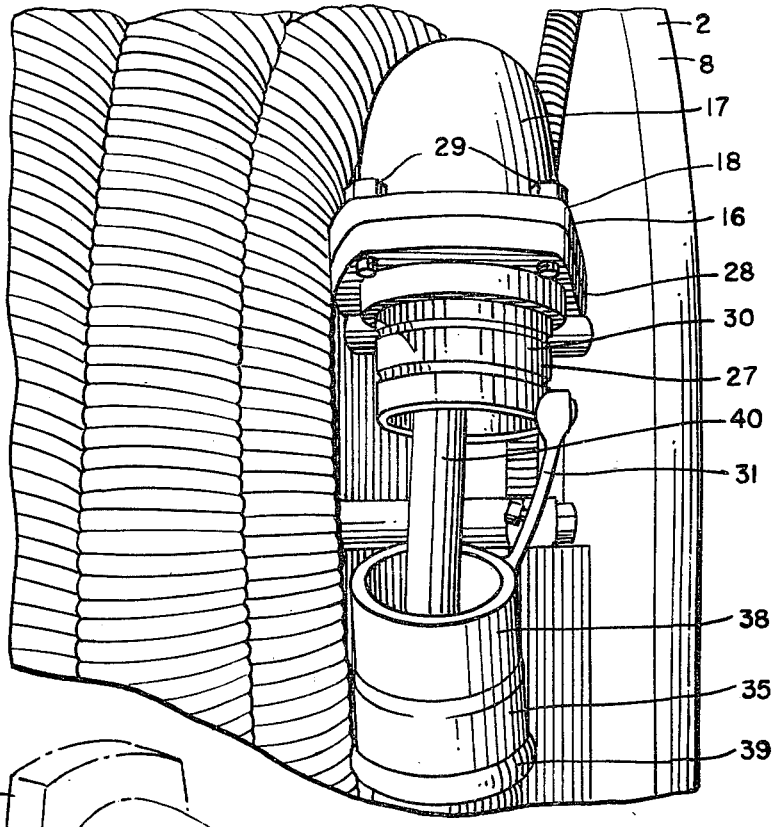
FIG. 3 is a fragmentary perspective view, similar to FIG. 2, but showing certain parts in a different position.

A fluid distribution apparatus 1, embodying the principles of the present invention, is shown in the drawings to illustrate the presently preferred embodiment of the present invention.

The apparatus 1, FIG. 1, embodies a reel 2 having a flexible conduit 3 connected thereto for winding onto and unwinding from the reel 2, as will be discussed in greater detail presently.

The reel 2 embodies a tubular central portion or axle 4, FIG. 7, and a body portion 5 disposed around and secured to the central portion 4. The body portion 5 includes a cylindrical portion 6 disposed between two end disks 7 and 8 and secured thereto by suitable means such as, for example, welding. The central portion 4 extends axially through the cylindrical portion 6 and the disks 7 and 8, and is secured to the disks 7 and 8 by suitable means such as, for example, welding.

The central portion 4 of the reel 2 is journaled in a supporting base 9 by suitable bearings 10 and 11, disposed on opposite sides of the body portion 5, so that the reel 2 is rotatable around the longitudinal axis of the central portion 4.

The central portion 4 has a passageway 12 extending longitudinally therethrough, and another passageway 13 extending radially outwardly therethrough from the passageway 12. A mounting plate 14, having a passageway 15 therethrough, is mounted on the central portion 4, by suitable means, such as, for example, welding, with the passageway 15 disposed in axial alignment with the passageway 13. A substantially L-shaped connector 16, having an elongated body portion 17 and two end flanges 18 and 19 is mounted on the central portion 4 with the flange 19 disposed in overlying relation to the mounting plate 14 and secured thereto by suitable means such as bolts 20, with the passageway 21 through the connector 16 being disposed in aligned relation with the passageway 15 in the mounting plate 14.

One end of the passageway 11 in the central portion 4 is closed by a suitable sealing member 22 in the bearing 11, and the opposite end portion 23 of the central portion 4 projects axially outwardly from the bearing 10 and is connected through a suitable swivel connection 24 to one end portion 25 of a stationary T-connector 26, FIG. 7, for a purpose which will be discussed in greater detail presently.

A connector 27, having a mounting plate 28 which is complementary in size and shape to the flange 18 on the L-shaped connector 16 is mounted on the flange 18 and secured thereto by suitable means such as bolts 29, FIGS. 2 and 3. The connector 27 embodies a substantially cylindrical shaped body portion 30 projecting from the side of the mounting plate 28 remote from the flange 18, and an elongated, spring biased latch lever 31 has one end portion 32 pivotally secured to the body portion 30 and another end portion 33 turned inwardly toward the center line of the body portion 30, FIG. 2. The connector 27 is afforded for releasably connecting the flexible conduit 3 to the L-shaped connector 16, as will be discussed in greater detail presently.

The flexible conduit 3 includes a vacuum hose 34, FIG. 1, having a connector 35 mounted on one end portion thereof, FIG. 2. The connector 35 has one end portion 36 disposed in the end portion 37 of the hose 34, and another end portion 38 adapted to fit into the body portion 30 of the connector 27 with a snug, freely slidable fit. A radially outwardly projecting flange 39 is disposed between the end portions 36 and 38 of the connector 35 in such position that, when the connector 35 is disposed in operative position in the connector 27, as shown in FIG. 2, the end portion 33 of the latch lever 31 is disposed in underlying, latching relation thereto. The lever 31 is spring biased into the aforementioned latching position thereof, and may be manually moved outwardly to release the end portion 33 from the flange 39 and permit withdrawal of the connector 35 from the connector 27, FIG. 3.

The flexible conduit 3 also embodies a fluid pressure hose 40, which is disposed in the vacuum hose 34, FIG. 1, and extends from a substantially Y-shaped connector 41, FIGS. 1 and 6, through the vacuum hose 34, the L-shaped connector 16, the central portion 4 of the reel 2 and the swivel 24, FIG. 7, into the T-connector 26, wherein it is connected by a suitable swivel connector 42, FIGS. 5 and 7, to a suitable stationary tube or conduit 43, FIGS. 1, 5 and 7.

The Y-connector 41 embodies one end portion or body portion 44 having two legs 45 and 46 extending therefrom. The end portion 44 embodies a tubular shaped outer member 47, which is of such size and shape as to fit into the end portion 48 of the vacuum hose 34, remote from the end portion 37 thereof with a snug, freely slidable fit. It also embodies a smaller tubular member 49, disposed in the outer member 47 and which, together with the leg 46 affords a tube 50 that extends outwardly through the body portion 47 at the end thereof remote from the vacuum tube 34, FIG. 6.

The end portion of the hose 40 disposed adjacent to the Y-connector 41 has a coupling 51 secured thereto, and is releasably secured to the end portion 49 of the pipe 50 by a coupling 52, which is disposed in outwardly projecting relation to the outer member 47 of the body portion 44 of the Y-connector 41. When the tube 40 is being connected to, or disconnected from the Y-connector 41, the vacuum tube 34 may be manually compressed along the hose 40 to thereby expose the coupling 51 thereon for ready manual engagement with, or disengagement from the coupling 52.

The legs 45 and 46 of the Y-connector 41 are of smaller cross sectional size than the body portion 44 thereof. The leg 45, which forms a continuation of the end portion 47 of the body portion 44, is connected by a suitable coupling 53 to one end of a vacuum hose 54, which is, preferably, of smaller cross sectional size than the vacuum hose 34. The free end portion of the leg 46 of the Y-connector 41 is connected to one end portion of a fluid pressure hose 55, FIG. 6. Preferably, the leg 46 is connected to the hose 55 through a suitable filter 56, the leg 46 being connected by a suitable coupling 57 to one end of the filter 56 and the other end of the filter 56 being connected by a suitable coupling 58 to the one end of the fluid pressure hose 55. The other ends of the hoses 54 and 55, not shown, may be disposed in operative position, such as, for example, at the location of a sander, or the like, for withdrawing air and dust from such location and for connection to the sander, or the like, respectively.

In the broader aspects of the present invention, the reel 2 of the fluid distribution apparatus 1 may be rotated in any suitable manner, such as, for example, manually to feed the conduit 3 on to, and off from the reel 2. However, in the preferred form of the present invention, the apparatus 1 embodies a sprocket wheel 59 mounted on, and secured to the disk 7 of the reel 2 in surrounding relation to the central portion 4, with a motor 60, having a sprocket wheel 61, mounted on the supporting member 9 in position to rotate the sprocket wheel 59 through a sprocket chain 62 disposed around the sprocket wheels 59 and 61. The motor 60 may be used to wind the conduit 3 onto the reel 2 and unwind it therefrom, or, if desired, it may be used only to wind the conduit 3 onto the reel 2, with the conduit 3 being manually pulled from the reel 2 for unwinding it therefrom.

If desired, a stop-member of any suitable type, such as, for example, a hollow, substantially donut-shaped ball 63, FIG. 1, may be mounted on the conduit 3 in position to be engaged by the supporting member 9 and a portion of the conduit 3, which has been wrapped onto the reel 2, and thereby automatically stop the winding of the conduit 3 onto the reel 2 with the Y-connector 41 disposed in outwardly spaced relation thereto.

The end portion of the fluid pressure hose 40, which is connected to the swivel 42, has a suitable coupling member 64 thereon, by which it may be connected to a complementary coupling member 65 of the swivel connector 42. As best seen in FIG. 5, in the preferred form of the present invention, the coupling members 64 and 65 and the swivel connector 42 are disposed in the T-connector 26 in position wherein they are accessible through the leg 66 of the T-connector 26, which is disposed perpendicular to the aligned legs 25 and 67 of the latter. With this construction, an effective guard is afforded around the connection of the hose 40 to the conduit 43, while maintaining the connection freely accessible for readily connecting the hose 40 to the conduit 43 and disconnecting the hose 40 from the conduit 43. The conduit 43 may be secured in stationary position in the T-connector 26 by any suitable means such as, for example, a plug 68, FIG. 1, threaded into the leg 67 of the connector 26, the connection of the stationary conduit 43 to the T-connector 26 being effective to hold the latter against rotation. The swivel connector 24, connecting the central member 4 to the T-connector 26, and the swivel connector 42, connecting the hose 40 to the stationary conduit 43 may be of any suitable type readily available on the market.

With this construction, it will be seen that, in the operation of the fluid distribution apparatus 1, the flexible conduit 3 may be readily unwound from the reel 2, either by pulling manually thereon, or by operation of the motor 60 until the desired length of the conduit 3 extends from the reel 2. The fluid pressure hose 55 may then be connected to the machine to be operated, such as, for example, the aforementioned sander, and the vacuum hose 54 may be disposed in operative position adjacent to the sander, or the like, such as, for example, by connecting it to a suitable hood, or the like, disposed around the sander, for withdrawing air and dust, under vacuum, from the area around the sander. When it is again desired to dispose the conduit 3 in stored position on the reel 1, the hose 55 may be disconnected from the sander, and the hose 54 may be disconnected from the hood, and the motor 60 may be actuated to thereby rotate the reel 1 in a clockwise direction, as viewed in FIG. 1, to thereby wind the conduit 34 back onto the reel 2.

Figure 4:
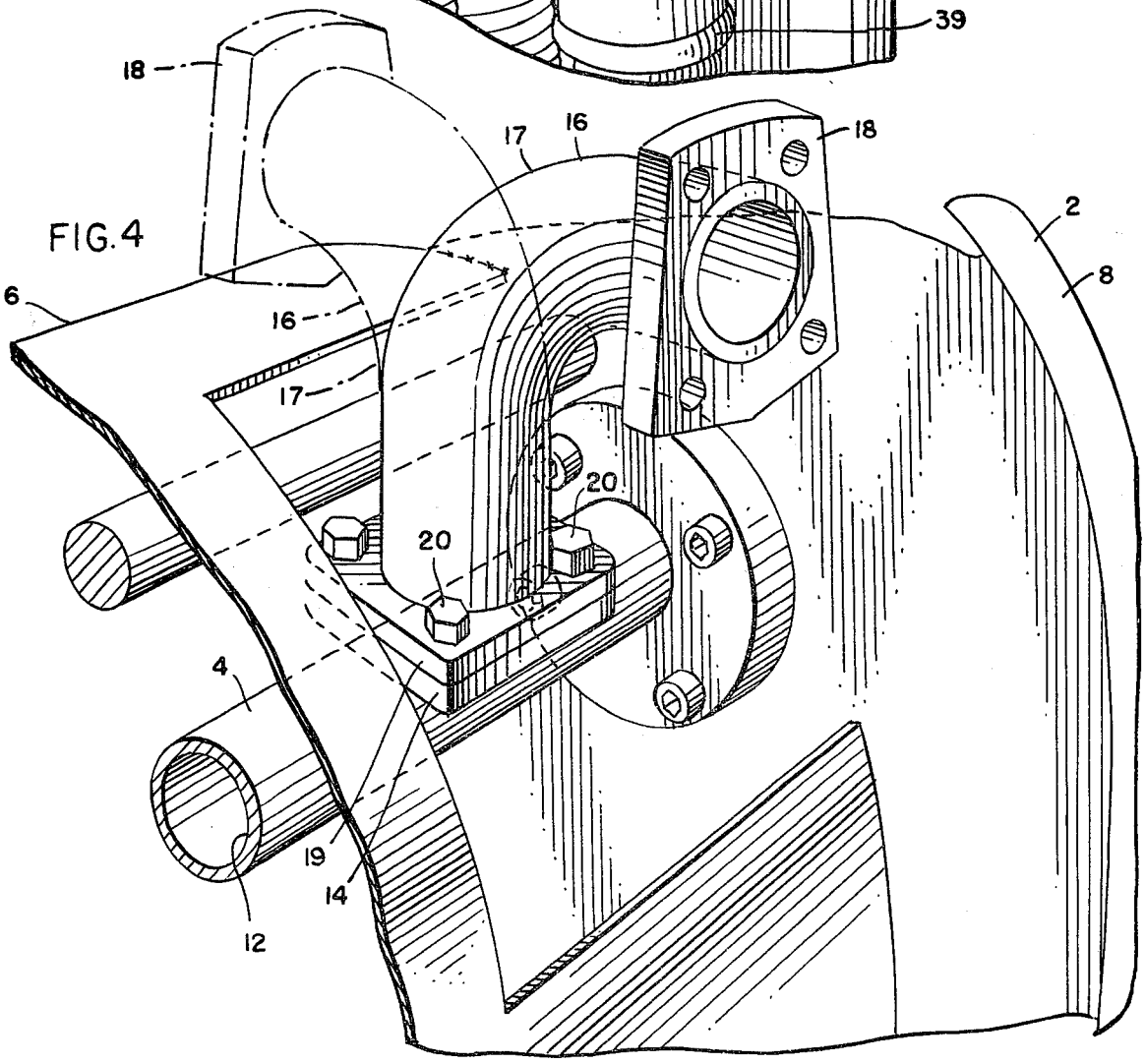
FIG. 4 is a detail, fragmentary, sectional, perspective view of the reel of the apparatus shown in FIG. 1, with the conduit removed therefrom.

It is to be observed that the L-shaped connector 16 is so constructed that, if desired, its position may be reversed on the mounting plate 14, as shown in broken lines in FIG. 4, to accommodate reversal of rotation of the reel 2 for winding and unwinding of the conduit 3.

With the apparatus 1 constructed in this manner, it affords a novel and practical apparatus for storing a fluid pressure hose and vacuum hose in an out-of-the-way position, when the apparatus is not being used, while affording apparatus from which the hoses may be readily withdrawn into operative position.

In addition, it will be seen that the present invention affords a novel fluid distribution apparatus of the aforementioned type, wherein the flexible conduit 3 may be quickly and easily connected to, and disconnected from the reel 2.

Also, it will be seen that the present invention affords a novel fluid distribution apparatus of the aforementioned type wherein the flexible conduit portion thereof may be readily connected to stationary fluid sources in a novel and expeditious manner.

In addition, it will be seen that the present invention affords a novel fluid distribution apparatus of the aforementioned type which is practical and efficient in operation, and which may be readily and economically produced commercially.

Thus, while I have illustrated and described the preferred embodiment of my invention, it is to be understood that this is capable of variation and modification, and I therefore, do not wish to be limited to the precise details set forth, but desire to avail myself of such changes and alterations as fall within the purview of the following claims.

I claim:

1. Fluid distribution apparatus comprising a. supporting means, b. a hose reel comprising (1) an elongated central portion rotatably mounted on said supporting means for rotation around the longitudinal axis of said central portion, and (2) a body portion disposed on said central portion for rotation therewith, c. conduit means, including said central portion, for feeding working fluid therethrough, d. said conduit means also including an elongated, flexible conduit adapted to be wound on said reel, e. said flexible conduit comprising an inner hose and an outer hose, said inner hoses disposed inside of the outer hose, f. connecting means on said central portion for affixing one end of said outer hose in communication with said central portion for the transfer of working fluid therethrough, g. said inner hose extending through said connecting means on said central portion and through said central portion for transferring working fluid therethrough, h. said central portion is journaled in said supporting means, and further includes (1) an outer stationary tubular member, extending radially outward from said body portion and in communication with said central portion, (2) an outer swivel connector connecting said outer stationary tubular member to said central portion, (3) an inner stationary tubular member, and (4) an iner swivel connector connecting said inner stationary tubular member to one end of said inner hoses;

i. said outer stationary tubular member comprises a T-connector having (1) a proximal end portion connected to said swivel connector, (2) a distal end portion disposed in substantially axial alignment with said proximal end portion, and (3) a middle end portion disposed between said proximal and distal end portions thereof and opening laterally to the axial alignment of said proximal and distal end portions, j. said inner stationary tubular member is disposed in said distal end portion; and k. said reel being rotatable for winding said flexible conduit onto said reel and unwinding said flexible conduit from said reel.

2. A fluid distribution apparatus as defined in claim 1, and in which a. said connecting means on said central portion comprises a substantially L-shaped member.

3. A fluid distribution apparatus as defined in claim 2, and in which a. said L-shaped member includes an elongated passageway therethrough for
   (1) connecting said end of said outer hose to said passageway in said central portion, and
   (2) receiving said inner hose extending therethrough.

4. A fluid distribution apparatus as defined in claim 2, and in which a. said L-shaped member comprises
   (1) a proximal end portion mounted on said central portion in juxtaposition thereto,
   (2) a distal end portion facing in the direction of unwinding rotation of said reel.

5. A fluid distribution apparatus as defined in claim 4, and in which a. said proximal end portion of said L-shaped member is reversible on said central portion to reverse the direction said distal end portion of said L-shaped member faces when rotation of said reel is reversed.

6. A fluid distribution apparatus as defined in claim 4, and a. which includes
   (1) a connector mounted on said distal end portion of said L-shaped member, and
   (2) an outer hose connector mounted on the end of said outer hose of said conduit, and
b. in which
   (1) said first mentioned connector includes
      (a) a tubular member having
         (1') a radially outwardly projecting annular member, and
   (2) said outer hose connector comprises
      (a) another tubular member
      (b) a latch lever having
         (1') one end pivotally connected to said other connector, and
         (2') a latch member projecting inwardly toward said tubular member and movable toward and away from latching engagement with said annular mamber upon pivoting of said latch lever around said one end thereof, and
         (3') spring means yieldingly urging said latch member into said latching engagement with said annular member.

7. The fluid distribution apparatus of claim 1 wherein said inner swivel connector is disposed in said T-connector in position to be accessible through said middle end portion outside said T-connector for connecting said inner swivel connector to, and disconnecting said inner swivel connector from said end portion of said inner hose.

8. Fluid distribution apparatus comprising a. supporting means,
b. a hose reel comprising
   (1) an elongated central portion rotatably mounted on said supporting means for rotation around the longitudinal axis of said central portion, and
   (2) a body portion disposed on said central portion for rotation therewith,
c. an elongated, flexible conduit adapted to be wound on said reel,
d. said conduit
   (1) comprising an inner hose and an outer hose, and said inner hose disposed within said outer hose and said conduit having a proximal end section and a distal end section,
e. said central portion having a passageway disposed longitudinally therein for feeding working fluid therethrough,
f. connecting means on said central portion affixing the proximal end of said outer hose to said central portion in communication with said passageway for transferring working fluid therethrough,
g. said inner hose extending through said connecting means and said passageway for transferring working fluid, and
h. said reel being rotatable in two opposite directions around said longitudinal axis of said central portion for
   (1) winding said conduit onto said reel, and
   (2) unwinding said conduit from said reel, respectively
i. said conduit includes a connector having
   (1) a proximal end segment, including an inner tubular member and an outer tubular member connected to respective ends of said hoses at said distal end section of said conduit, and
   (2) a distal end segment wherein said inner tubular member extends through the wall of said outer tubular member and said inner and outer members are disposed in side-by-side relation to each other.

9. A fluid distribution apparatus as defined in claim 8, and in which a. said inner hose comprises a pressure hose for feeding working fluid under pressure-therethrough from one portion of said conduit toward said other portion thereof, and
b. said outer hose comprises a vacuum hose for withdrawing working fluid under vacuum therethrough from said other portion of said conduit toward said one portion thereof.

10. A fluid distribution apparatus comprising a. supporting means,
b. a hose reel comprising
   (1) an elongated central portion rotatably mounted on said supporting means for rotation around the longitudinal axis of said central portion, and
   (2) a body portion disposed on said central portion for rotation therewith,
c. an elongated, flexible conduit adapted to be wound on said reel,
d. said conduit
   (1) comprising an inner hose and an outer hose, and said inner hose disposed within said outer house and said conduit having a proximal end section and a distal end section,
   e. said central portion having a passageway disposed longitudinally therein for feeding working fluid therethrough
   f. connecting means on said central portion affixing the proximal end of said outer hose to said central portion in communication with said passageway for transferring working fluid therethrough, g. said inner hose extending through said connecting means and said passageway for transferring working fluid, and h. said reel being rotatable in two opposite directions around said longitudinal axis of said central portion for (1) winding said conduit onto said reel, and (2) unwinding said conduit from said reel, respectively, i. said central portion is journaled in said supporting means, and further comprises (1) an outer stationary tubular member, extending radially outward from said body portion and in communication with said central portion, (2) an outer swivel connector connecting said outer stationary tubular member to said central portion, (3) an inner stationary tubular member, and (4) an inner swivel connector connecting said inner stationary tubular member to one end of said inner hose.

11. A fluid distribution apparatus as defined in claim 10, and in which a. said outer stationary tubular member comprises a T-connector comprising (1) a proximal end portion connected to said swivel connector, (2) a distal end portion disposed in substantially axial alignment with said proximal end portion, and (3) a middle end portion disposed between said proximal and distal end portions thereof and opening laterally to the axial alignment of said proximal and distal end portions, b. said inner stationary tubular member is disposed in said distal end portion, and c. said inner swivel connector is disposed in said T-connector.

12. A fluid distribution apparatus as defined in claim 11, and in which a. said inner swivel connector is disposed in said T-connector in position to be accessible through said middle end portion from outside said T-connector for connecting said inner swivel connector from said end portion of said inner hose.

* * * * *